US007298200B2

(12) United States Patent
Won

(10) Patent No.: US 7,298,200 B2
(45) Date of Patent: Nov. 20, 2007

(54) VOLTAGE GENERATION CIRCUITS FOR SUPPLYING AN INTERNAL VOLTAGE TO AN INTERNAL CIRCUIT AND RELATED METHODS

(75) Inventor: Myung-Gyoo Won, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 120 days.

(21) Appl. No.: 10/921,619

(22) Filed: Aug. 19, 2004

(65) Prior Publication Data

US 2005/0073356 A1 Apr. 7, 2005

(30) Foreign Application Priority Data

Oct. 2, 2003 (KR) ..... 10-2003-0068801

(51) Int. Cl.
*G05F 1/10* (2006.01)

(52) U.S. Cl. ..... 327/541; 323/313

(58) Field of Classification Search ..... 327/538, 327/540, 541, 543, 545, 546; 323/313, 316
See application file for complete search history.

(56) References Cited

U.S. PATENT DOCUMENTS 5,121,007 A * 6/1992 Aizaki ..... 327/544
5,249,155 A * 9/1993 Arimoto et al. ..... 365/222
5,321,653 A * 6/1994 Suh et al. ..... 365/189.09
5,485,117 A * 1/1996 Furumochi ..... 327/538
5,493,234 A * 2/1996 Oh ..... 326/33
5,656,944 A * 8/1997 Choi ..... 324/763
5,696,465 A * 12/1997 Ishizuka ..... 327/544
5,896,324 A * 4/1999 Jang et al. ..... 365/189.07
6,011,428 A * 1/2000 Tsukude et al. ..... 327/541
6,038,189 A * 3/2000 Morishita ..... 365/227
6,046,624 A * 4/2000 Nam et al. ..... 327/530
6,072,742 A * 6/2000 Ooishi ..... 365/226

(Continued)

FOREIGN PATENT DOCUMENTS

KR 10-2003-0002079 1/2003

(Continued)

OTHER PUBLICATIONS

Notice to File a Response/Amendment to the Examination Report for Korean patent application 10-2003-0068801 mailed on Jun. 30, 2005.

*Primary Examiner*—Kenneth B. Wells
*Assistant Examiner*—Thomas J. Hiltunen
(74) *Attorney, Agent, or Firm*—Myers Bigel Sibley & Sajovec

(57) ABSTRACT

Internal voltage generators are provided, as well as methods of overdriving an internal voltage generation circuit. Embodiments of the internal voltage generator comprise a first driver for receiving an external voltage to supply an internal voltage to the internal circuit in response to an input voltage; a comparator for comparing a reference voltage with a fed-back internal voltage to generate the input voltage of the first driver; a variable pulse generating circuit responsive to an input pulse; and a second driver for dropping the input voltage of the first driver to a ground voltage in response to the variable pulse produced by the variable pulse generating circuit. The internal voltage generator can generate the internal voltage of a relatively constant level without regard to increase of the external voltage or frequency of an operating signal.

19 Claims, 12 Drawing Sheets

U.S. PATENT DOCUMENTS 6,184,744 B1 * 2/2001 Morishita ..... 327/541
6,222,403 B1 * 4/2001 Mitsuda ..... 327/170
6,310,511 B1 * 10/2001 Weinfurtner ..... 327/540
6,452,854 B1 * 9/2002 Kato et al. ..... 365/226
6,512,715 B2 * 1/2003 Okamoto et al. ..... 365/227
6,614,707 B2 * 9/2003 Kato ..... 365/226
6,625,050 B2 * 9/2003 Suwa et al. ..... 365/63
6,650,175 B2 * 11/2003 Messager ..... 327/541
6,809,577 B2 * 10/2004 Matsumoto et al. ..... 327/541
6,954,103 B2 * 10/2005 Yamauchi et al. ..... 327/540

FOREIGN PATENT DOCUMENTS

KR 10-2003-0002079 8/2003

* cited by examiner

VOLTAGE GENERATION CIRCUITS FOR SUPPLYING AN INTERNAL VOLTAGE TO AN INTERNAL CIRCUIT AND RELATED METHODS

CLAIM OF PRIORITY

This application claims priority from Korean Patent Application No. 2003-68801, filed on Oct. 2, 2003, the contents of which is herein incorporated by reference in its entirety.

FIELD OF THE INVENTION

The present invention relates to semiconductor devices, and more particularly, to internal voltage generators for semiconductor devices.

DESCRIPTION OF THE RELATED ART

As semiconductor memory devices become more highly integrated, the size of the chips are reduced. The reduction in chip size generally acts to lower the operating voltages. With the increasing use of semiconductor memory devices in portable systems, such as, for example, notebook computers and mobile communication equipment, extensive efforts have been made to lower the operating voltage of semiconductor chips.

With the tendency to smaller chip size, an internal voltage, instead of an external voltage, has generally been used as the operating voltage of the chip. An internal voltage generator for generating an internal voltage is mounted on the chip and supplies the operating voltage to an internal circuit.

Such an internal voltage generator is designed to supply a constant internal voltage. The internal voltage generator generally includes a comparator and a feedback transistor. The comparator is configured to compare a reference voltage with the internal voltage. If the internal voltage is higher than the reference voltage, the comparator outputs, for example, a high (H) signal to turn off the feedback transistor. If the internal voltage is lower than the reference voltage, the comparator outputs, for example, a low (L) signal to turn on the feedback transistor. If the feedback transistor is turned on, an external voltage is supplied that increases the internal voltage.

However, if current consumption of the internal circuit momentarily increases, a phenomenon may occur in which the internal voltage is temporarily lowered due to delays in response time of the comparator and the feedback transistor. If the internal voltage is lowered, the operating speed of the internal circuit may be reduced.

For example, with a memory device, if the internal voltage is lowered due to high current consumption when the bit line is sensed, the sensing speed, and hence the speed of the operation, is reduced. In order to prevent this phenomenon, an external voltage may be supplied as an internal voltage by generating an overdriving pulse to momentarily increase the internal voltage. The overdriving pulse allows current to flow across the feedback transistor during a predetermined pulse period.

FIG. 1 is a schematic block diagram of an internal voltage generator, which is disclosed in Korean Patent Application No. 10-2001-0038817, and FIG. 2 is a graph showing how the internal voltage of FIG. 1 varies with application of an external voltage.

In the internal voltage generator of FIG. 1, when the operating signal PS is activated to a high (H) level, a pulse generating circuit 20 generates a pulse P1. An NMOS transistor MN1 is turned on in response to the pulse P1. When this occurs, the voltage of node N1 becomes the ground voltage VSS (i.e., is set to a low (L) level). When the node N1 is set to a low (L) level, PMOS transistor MP1 is turned on, so that an external voltage VDD is supplied as an internal voltage to the internal circuit 30.

As the width of the pulse P1 is fixed, the external voltage continues to be supplied as the internal voltage while the pulse P1 is at a high level. As a result, the externally supplied current may exceed the current that is consumed by the internal circuit 30.

In addition, as shown in FIG. 2, a problem may occur in that the supplied current may exceed the consumed current, thus increasing the internal voltage. Further, there occurs a problem in that the internal voltage increases in a direction from V1 to V3 due to an accumulation of the supplied current in accordance with frequency of the operation signal PS below the increased external voltage.

SUMMARY OF THE INVENTION

Pursuant to certain embodiments of the present invention, circuits for selectively supplying an external voltage to an internal circuit are provided that include (1) a pulse generation circuit that is configured to generate a pulse having a pulse length that is a function of an internal voltage and (2) a first driver circuit that couples the external voltage to the internal circuit in response to the pulse. In these circuits, the pulse generation circuit may generate the pulse in response to an input pulse, and the pulse generation circuit may terminate the pulse in response to the internal voltage falling below a first reference voltage. The first driver circuit may comprise, for example, a transistor that selectively couples the external voltage to the internal circuit.

The above-described circuits may also include a second driver circuit that couples the pulse to the first driver circuit. The second driver circuit may be implemented, for example, as a transistor that selectively couples a second reference voltage to the first driver circuit in response to the pulse. The circuit may further include a comparator, and the first driver circuit may selectively couple the external voltage to the internal circuit responsive to the output of the comparator. The input pulse may be activated in response to an operation of the internal circuit.

In certain embodiments of the invention, the pulse generation circuit may be implemented as a differential amplifier that is configured to receive the first reference voltage and the internal voltage, and a sensing unit that is configured to sense the level of the internal voltage. The pulse generation circuit may also include a precharge unit. The sensing unit may be implemented as at least one resistor disposed between first and second transistors of the differential amplifier. The pulse generation circuit may also include a delay circuit that is configured to activate the pulse at a predetermined time after activation of the input pulse.

Pursuant to further embodiments of the present invention, methods of overdriving an internal voltage generation circuit that supplies an operating voltage to an internal circuit are provided. Pursuant to these methods, a control signal is activated in response to an operation of the internal circuit. The internal voltage generation circuit is overdriven in response to the control signal. The control signal is deactivated in response to the operating voltage reaching a predetermined level. The overdrive of the internal circuit may be terminated in response to deactivation of the control signal.

In the above referenced embodiments of the present invention, the predetermined level that the operating voltage reaches may be the level of a first reference voltage. The overdriving of the internal voltage generation circuit comprises may be accomplished, for example, by coupling an external voltage to the internal circuit. This coupling may be accomplished by coupling a second reference voltage to a first driver circuit via a second driver circuit in response to the control signal, and then coupling the external voltage to the internal circuit via the first driver circuit in response to the second reference voltage. In certain embodiments of the present invention, the first driver circuit may be a PMOS transistor and the second driver circuit may be an NMOS transistor. The overdriving of the internal voltage generation circuit may be done a predetermined time after activation of the control signal.

Pursuant to still further embodiments of the present invention, voltage generation circuits for supplying an operating voltage to an integrated circuit are provided which include a pulse generating circuit, a comparator, and a first driver circuit that selectively couples an external voltage to the integrated circuit in response to an output of the pulse generating circuit and an output of the comparator. In these voltage generation circuits, the pulse generating circuit may generate a pulse having a pulse length that is a function of the operating voltage. For example, the pulse generating circuit may activate the pulse in response to an input signal and/or deactivate the pulse in response to the operating voltage falling below a reference voltage.

The first driver circuit may couple the external voltage to the integrated circuit in response to the output of the comparator indicating that a reference voltage exceeds the operating voltage and/or in response to the pulse generating circuit generating the pulse. In certain embodiments, the first driver circuit may be implemented as a transistor. The voltage generation circuit may also include a second driver circuit that couples the output of the pulse generating circuit to the control terminal on the transistor of the first driver circuit. The pulse may be activated in response to an operation of the internal circuit.

The pulse generating circuit may be implemented as a differential amplifier that is configured to receive the reference voltage and the operating voltage and a sensing unit that is configured to sense the level of the operating voltage. The sensing unit may include at least one resistor disposed between first and second transistors of the differential amplifier or a plurality of resistors controlled by a voltage divider circuit. The pulse generating circuit may also include a delay circuit that is configured to activate the pulse at a predetermined time after activation of the input signal. The comparator may compare the operating voltage to a reference voltage, and the pulse generating circuit may activate the pulse in response to an input signal and may deactivate the pulse in response to the operating voltage falling below a voltage sensing level voltage that is a predetermined amount more than the reference voltage.

Pursuant to still further embodiments of the present invention, internal voltage generators for supplying an internal voltage to an internal circuit are provided that include a first driver that is configured to supply an external voltage as the internal voltage to the internal circuit in response to a first input signal and/or a second input signal, a comparator that is configured to compare a reference voltage with the internal voltage to generate the first input signal, a variable pulse generating circuit responsive to an input pulse that senses the reference voltage and the internal voltage to generate a variable pulse, and a second driver that generates the second input signal in response to the variable pulse.

BRIEF DESCRIPTION OF THE DRAWING

The accompanying drawings, which are included to provide a further understanding of the invention and are incorporated in and constitute a part of this application, illustrate certain embodiment(s) of the invention. In the drawings.

DETAILED DESCRIPTION OF THE INVENTION

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first layer could be termed a second layer, and, similarly, a second layer could be termed a first layer without departing from the scope of the present invention. As used herein, the term "and/or" includes any and all combinations of one or more of the associated listed items.

The terminology used herein is for the purpose of describing particular embodiments only and is not intended to be limiting of the invention. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
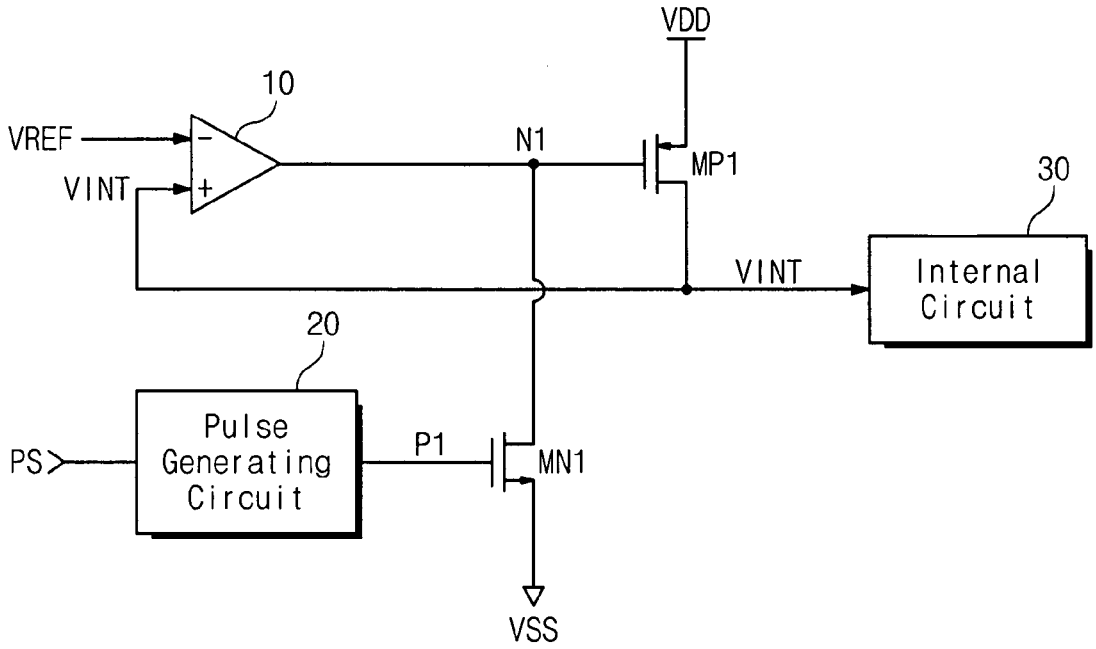
Fig. 1 (PRIOR ART)
FIG. 1 is a block diagram of a conventional internal voltage generator.
Figure 2:
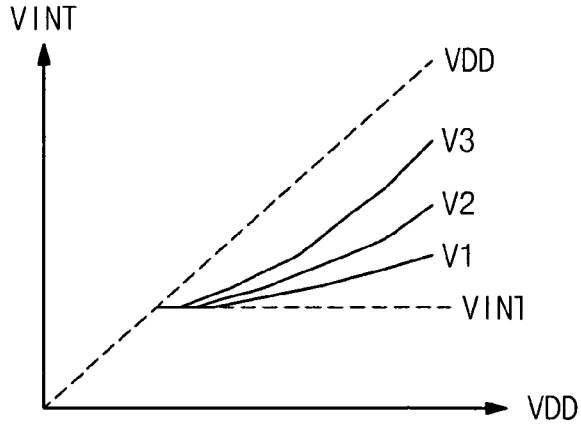
Fig. 2 (PRIOR ART)
FIG. 2 is a graph illustrating the internal voltage as a function of the external voltage with the conventional internal voltage generator of FIG. 1.
Figure 3:
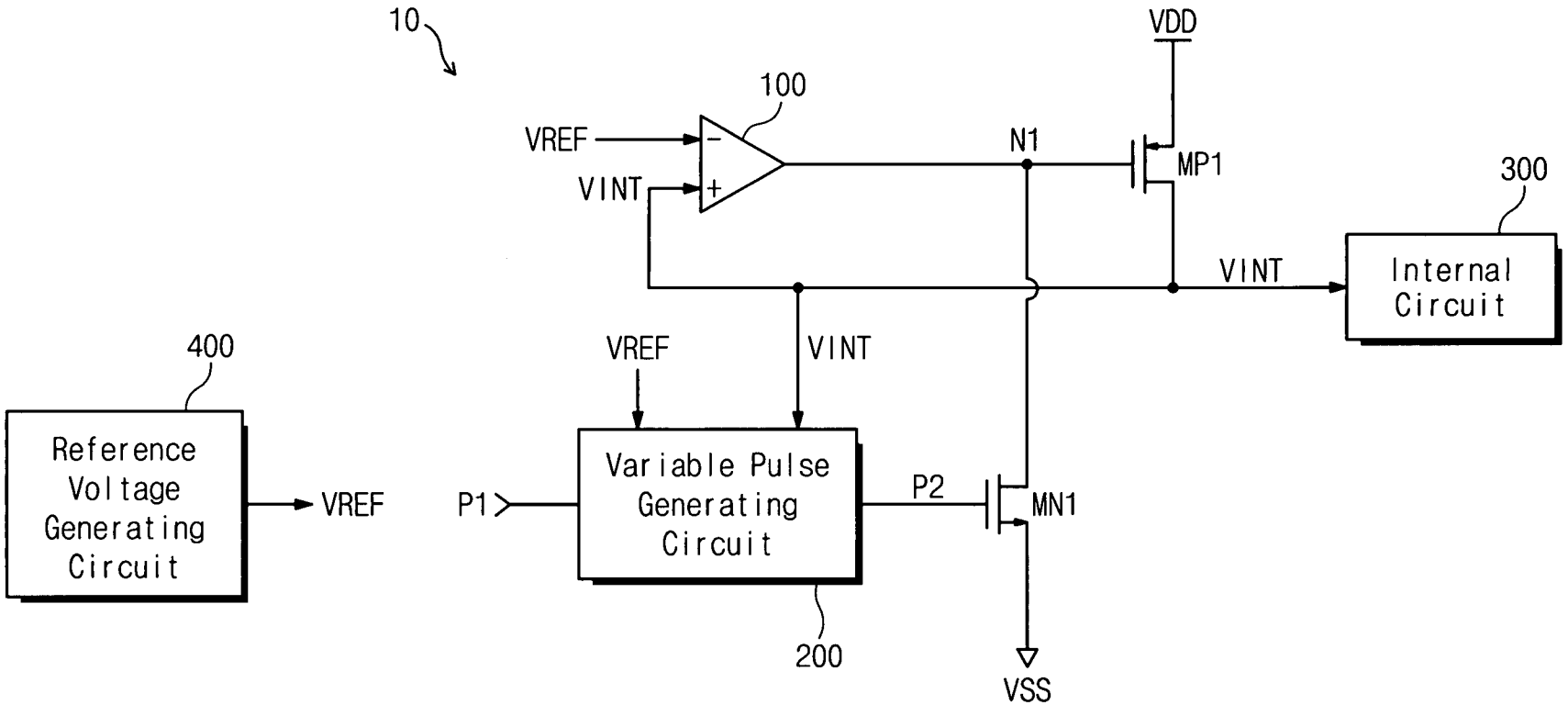
FIG. 3 is a block diagram of an internal voltage generator according to certain embodiments of the present invention.

FIG. 3 is a block diagram of an internal voltage generator 10 according to embodiments of the present invention. The internal voltage generator 10 may provide an internal voltage of a relatively constant level.

As shown in FIG. 3, the internal voltage generator 10 includes a first driver, a comparator 100, a variable pulse generating circuit 200, and a second driver.

The first driver is a circuit that receives an external voltage VDD which is supplied as an internal voltage to an internal circuit 300. In this embodiment, the first driver comprises a pull-up transistor MP1. The source of the pull-up transistor MP1 receives the external voltage VDD, the drain of transistor MP1 is connected to the internal circuit 300, and the gate of transistor MP1 is electrically connected to both the comparator 100 and the second driver. The pull-up transistor MP1 is a PMOS transistor.

The comparator 100 compares a reference voltage VREF with the internal voltage VINT and generates a control signal that controls the input voltage of the first driver. As shown in FIG. 3, the reference voltage VREF is generated from a reference voltage generator 400, and the internal voltage VINT is fed back from the first driver. If the internal voltage VINT is lower than the reference voltage VREF, the comparator 100 generates a low (L) signal to turn on the first driver. When this occurs, the external voltage VDD is supplied as the internal voltage VINT. If the internal voltage VINT is higher than the reference voltage VREF, the comparator 100 generates a high (H) signal to turn off the first driver.

The variable pulse generating circuit 200 is responsive to an input pulse P1. The variable pulse generating circuit 200 senses the level of the internal voltage VINT and generates an output pulse P2. The reference voltage VREF is generated from the reference voltage generating circuit 400 and the internal voltage VINT is fed back from the first driver.

The output pulse P2 is a variable pulse. Thus, in certain embodiments of the present invention, the output pulse P2 is "pulled up" to a high level when (1) the input pulse P1 is pulled up or (2) at a time period that is delayed from the time at which the input pulse P1 is pulled up by a predetermined time. The output pulse P2 is "pulled down" to a low level when the internal voltage VINT becomes lower than the reference voltage VREF. A construction and operation of the variable pulse generating circuit 200 will be described in detail herein with reference to FIGS. 4-6.

The second driver reduces the input voltage of the first driver to the ground voltage VSS in response to the output pulse P2. In the embodiment of the present invention depicted in FIG. 3, the second driver includes a pull-down transistor MN1. The source of pull-down transistor MN1 receives the input voltage of the first driver, the drain of transistor MN1 is connected to the ground voltage VSS, and the gate of transistor MN1 is connected to the variable pulse generating circuit 200. The pull-down transistor MN1 is an NMOS transistor.

The operation of the internal voltage generator 10 will now be described with reference to FIG. 3.

As shown in FIG. 3, the external voltage VDD is supplied as the internal voltage VINT through the first driver. If the internal voltage VINT supplied to the internal circuit 300 drops so that it is lower than the reference voltage VREF, the comparator 100 compares the reference voltage VREF with the fed-back internal voltage to generate a low (L) signal. The low signal is input to the first driver, and the PMOS transistor MP1 is turned on to supply the external voltage.

During normal operations, current consumption in the internal circuit 300 may be momentarily excessive. When this happens, a phenomenon may occur in which the internal voltage is temporarily lowered due to the response time and feedback time of the comparator 100. In addition, if the external voltage is supplied excessively, the internal voltage may be increased too much.

This phenomenon may be avoided and an internal voltage having a relatively constant level may be provided by the variable pulse generating circuit 200 receiving the pulse P1 when the internal circuit 300 operates, and generating the variable pulse P2. The variable pulse P2 is set to a high level (1) when the pulse P1 set to a high level or (2) at a time period that is delayed from the time when the pulse P1 is set to a high level by a predetermined time. The variable pulse P2 is set to a low level when the internal voltage becomes lower than the reference voltage.

While the variable pulse P2 is in a high (H) state, the second driver drops the input voltage of the first driver to the ground voltage VSS. When this occurs, the external voltage VDD is supplied as the internal voltage. If the internal voltage VINT becomes lower than the reference voltage VREF, the variable pulse P2 is set to a low level and the second driver is turned off. In this manner, a stable internal voltage having a relatively constant level is supplied to the internal circuit 300.

Figure 4A:
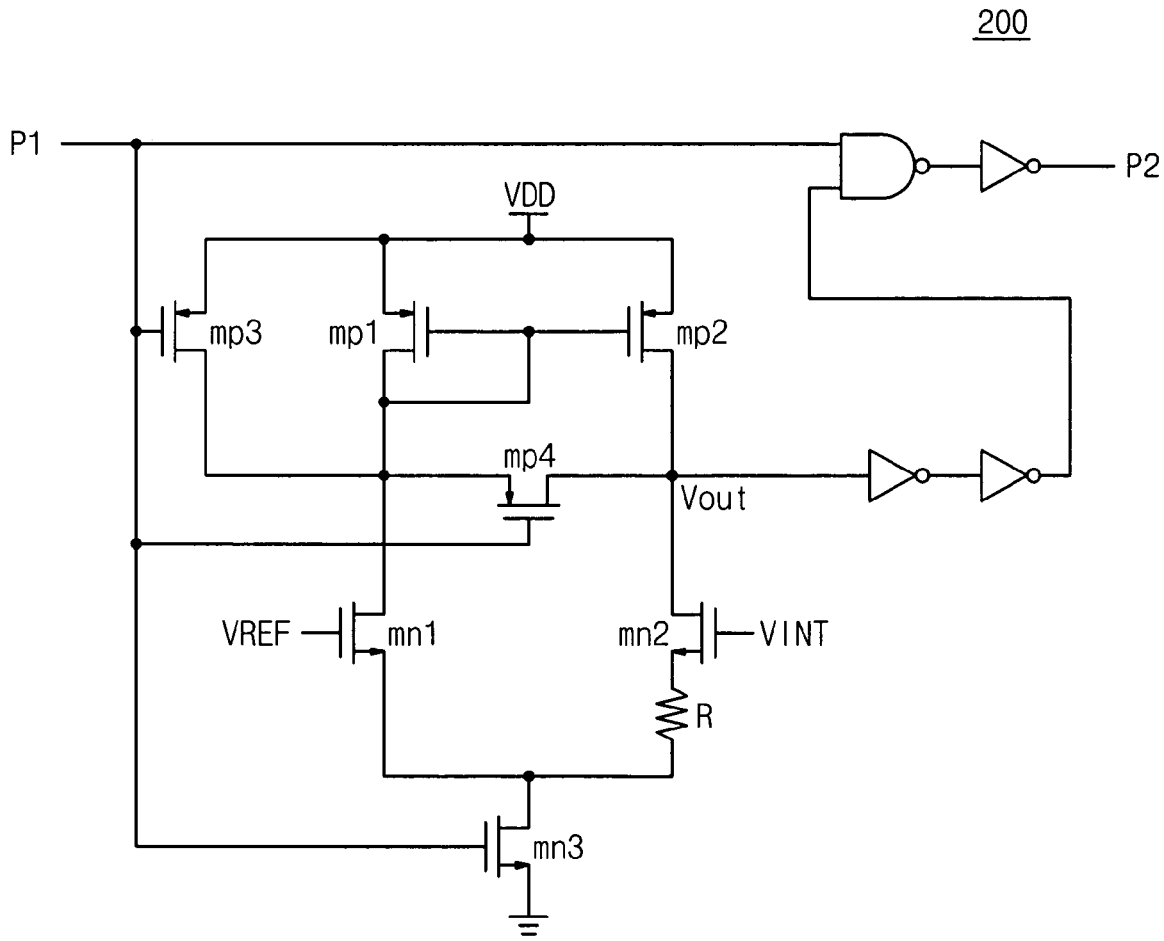
FIG. 4A is a circuit diagram of the variable pulse generating circuit of FIG. 3 according to a first embodiment of the present invention.
Figure 4B:
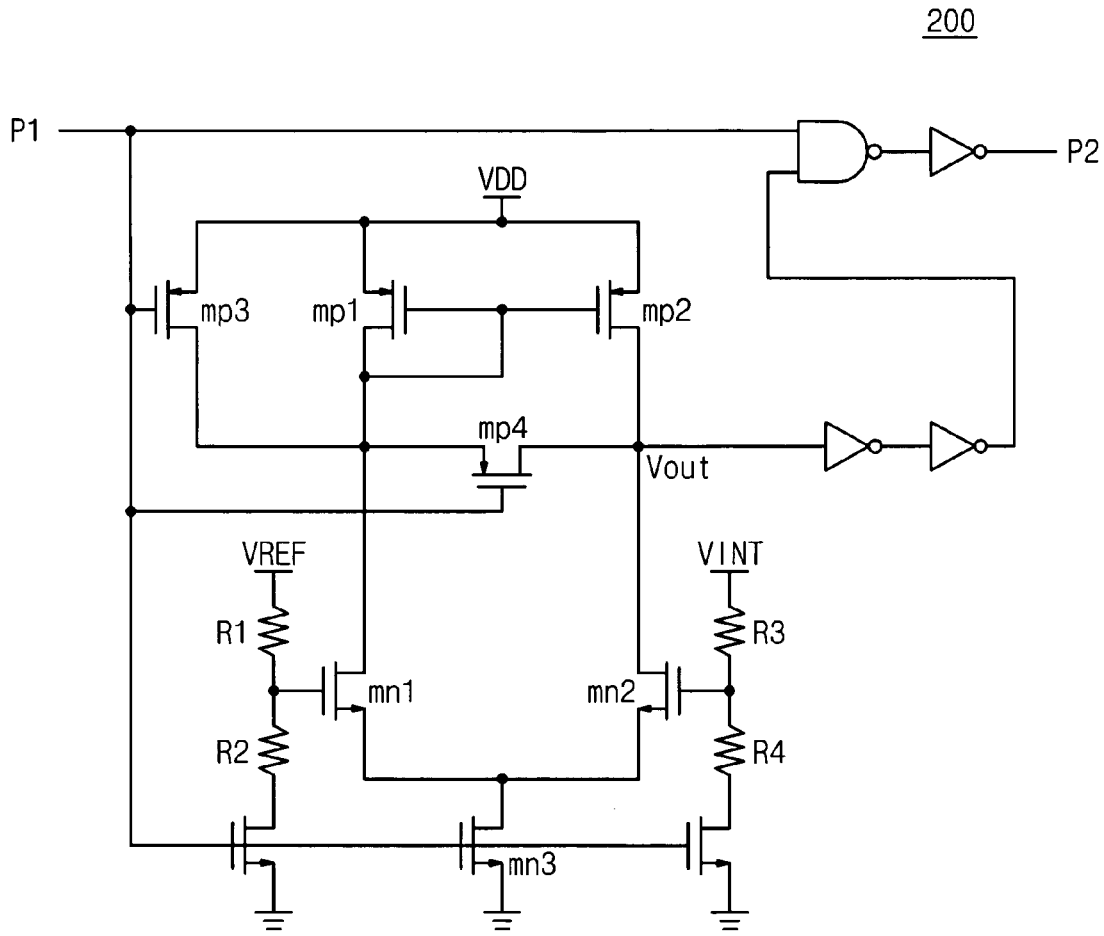
FIG. 4B is a circuit diagram of the variable pulse generating circuit of FIG. 3 according to a second embodiment of the present invention.
Figure 4C:
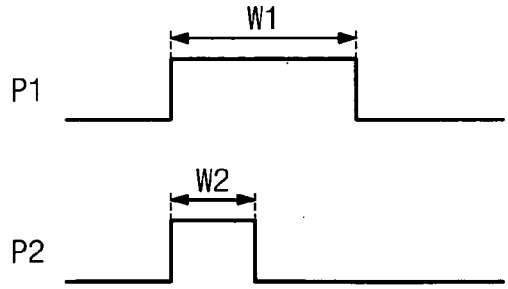
FIG. 4C depicts the waveforms of the input pulse and the output pulse of FIG. 4A or 4B.
Figure 4D:
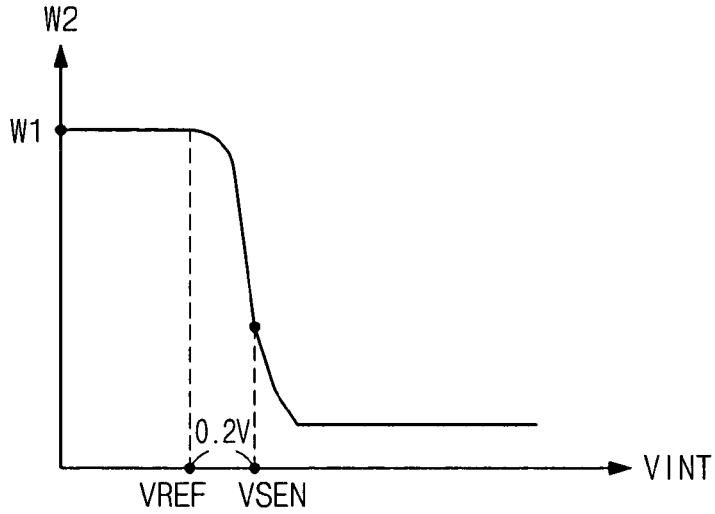
FIG. 4D is a graph illustrating the width of the output pulse as a function of the internal voltage of FIG. 4A or 4B.
Figure 4E:
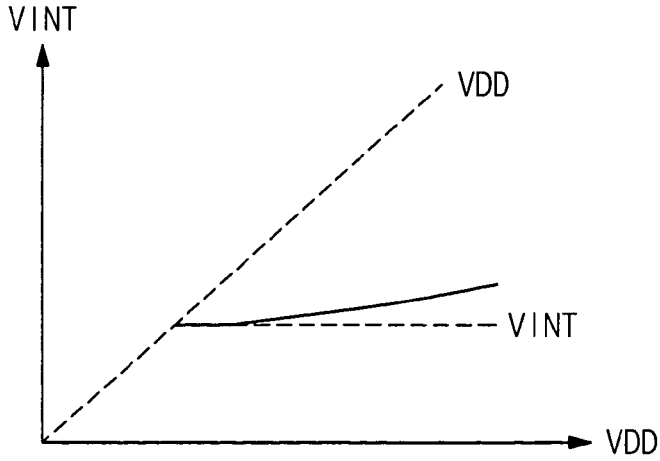
FIG. 4E is a graph of the internal voltage as a function of the external voltage of FIG. 3.

FIG. 4A is a circuit diagram of the variable pulse generating circuit of FIG. 3 according to a first exemplary embodiment of the present invention, and FIG. 4B is a circuit diagram of the variable pulse generating circuit of FIG. 3 according to a second exemplary embodiment of the present invention. FIG. 4C depicts waveforms of the input pulse P1 and the output pulse P2. FIG. 4D is a graph illustrating the width W2 of the output pulse P2 as a function of the internal voltage, and FIG. 4E is a graph illustrating levels of the internal voltage as a function of the external voltage.

As shown in FIGS. 4A and 4B, the variable pulse generating circuits 200 each include a differential amplifier configured to receive the reference voltage VREF and the internal voltage VINT, a precharge unit, and an internal voltage sensing level unit. The differential amplifier includes PMOS transistors mp1 and mp2 and NMOS transistors mn1 and mn2. The precharge unit includes PMOS transistors mp3 and mp4. The internal voltage sensing level unit includes resistor R in the embodiment of FIG. 4A, and resistors R1, R2, R3 and R4 in the embodiment of FIG. 4B.

First, operation of the variable pulse generating circuit 200 will be described as if the internal voltage sensing level unit was not present. When the input pulse P1 is in a low (L) state, the PMOS transistors mp3 and mp4 are turned on. As such, the external voltage VDD precharges the output terminal Vout of the differential amplifier. When the output terminal Vout of the differential amplifier is precharged to a high (H) state and the input pulse P1 is at a high level, both input terminals of the NAND gate are at high (H) levels. As a result, the output pulse P2 is set to a high level. In other words, the output pulse P2 is set to a high level as soon as the input pulse P1 is set to a high level.

While the input pulse P1 is in a high (H) state, the PMOS transistors mp3 and mp4 are turned off and the NMOS transistor mn3 is turned on. If, when the input pulse P1 is in a high (H) state, the internal voltage VINT is higher than the reference voltage VREF, the output terminal Vout of the differential amplifier is set to a low (L) state, and the output pulse P2 is set to a low level because the two terminals of the NAND gate are in high (H) and low (L) states, respectively. As a result, the output pulse P2 is generated as shown in FIG. 4C.

Now, an operation of the variable pulse generating circuits 200 of FIGS. 4A and 4B that include the internal voltage sensing level units will be described. In the embodiments of FIGS. 4A and 4B, the internal voltage sensing level units are implemented using resistors. The internal voltage sensing level may be formed at a voltage that is higher than the reference voltage VREF by a predetermined level (for example, 0.2 V). The predetermined level may be changed by changing the resistance level. The output pulse P2 is set to a low level when the internal voltage VINT becomes higher than the internal voltage sensing level.

In the embodiment of FIG. 4A, the internal voltage sensing level unit is disposed between the NMOS transistors mn2 and mn3 of the differential amplifier and is controlled by the resistor R. The internal voltage sensing level unit of the embodiment of FIG. 4B is disposed at both the internal voltage input terminal and the reference voltage input terminal of the differential amplifier, and is controlled by a voltage divider circuit. A switching transistor is disposed in a lower portion of the voltage divider circuit in order to reduce consumption of standby current.

FIG. 4D is a graph illustrating the width W2 of the output pulse as a function of the internal voltage. As shown in FIG. 4D, if the internal voltage VINT is lower than the reference voltage VREF or the internal voltage sensing level while the input pulse P1 is in a high (H) state, the width W2 of the output pulse P2 is equal to the width W1 of the input pulse P1. The output pulse P2 is set to a low level when the internal voltage VINT becomes higher than the reference voltage VREF or the internal voltage sensing level VSEN.

The variable pulse generating circuits 200 of FIG. 4A or 4B may advantageously provide high operating speed because the output pulse P2 is set to a high level as soon as the input pulse P1 is set to a high level. As shown in FIG. 4D, however, a minimum width of the output pulse P2 cannot become zero. The minimum pulse width of the output pulse P2 is determined by the response time of the differential amplifier.

FIG. 4E is a graph illustrating the internal voltage VINT as a function of the external voltage VDD in the internal voltage generator having the variable pulse generating circuit of FIG. 4A or 4B. As shown, the internal voltage VINT is maintained within a predetermined range in accordance with the external voltage VDD.

Figure 5A:
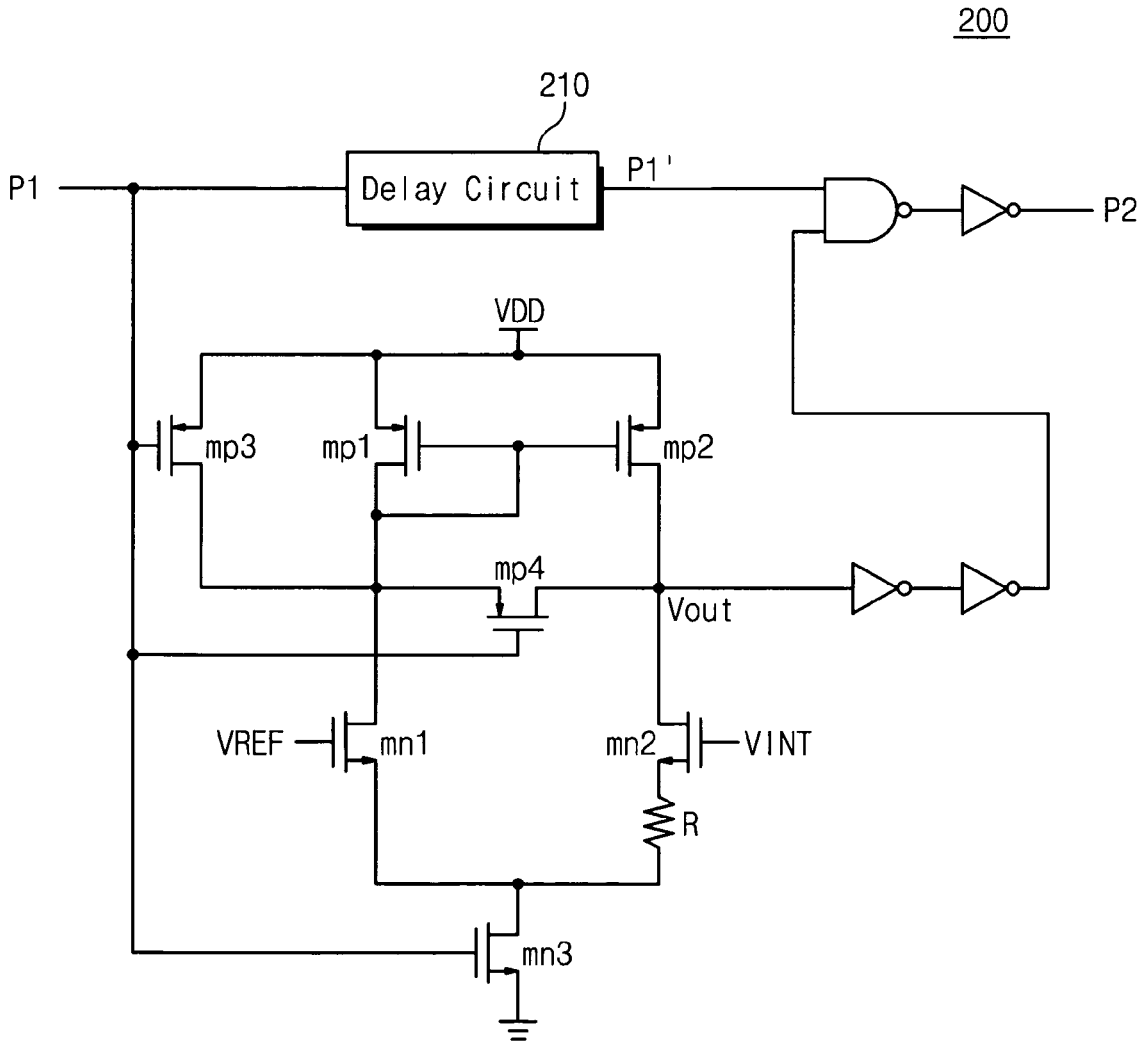
FIG. 5A is a circuit diagram of the variable pulse generating circuit of FIG. 3 according to a third embodiment of the present invention.
Figure 5B:
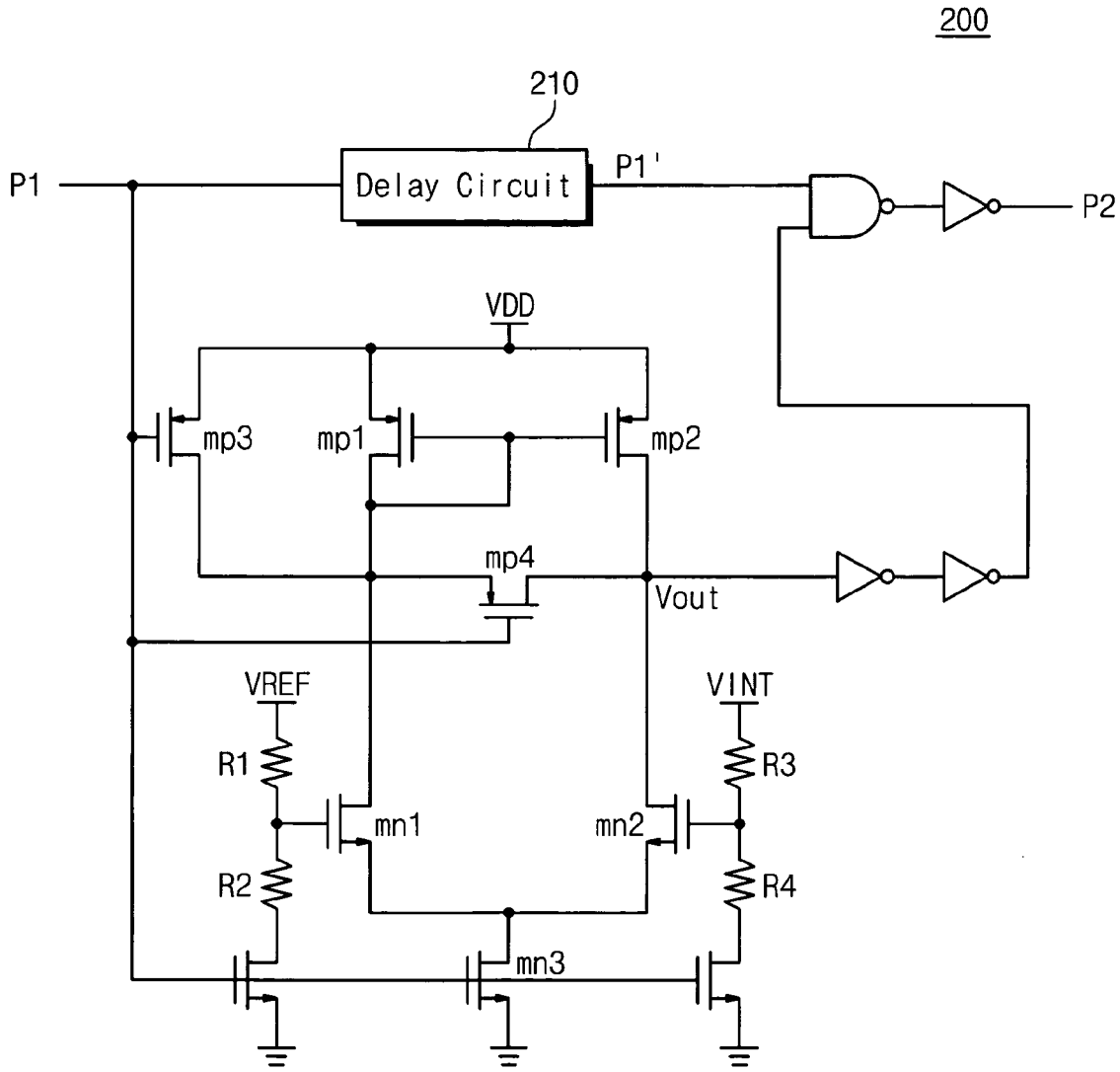
FIG. 5B is a circuit diagram of the variable pulse generating circuit of FIG. 3 according to a fourth embodiment of the present invention.
Figure 5C:
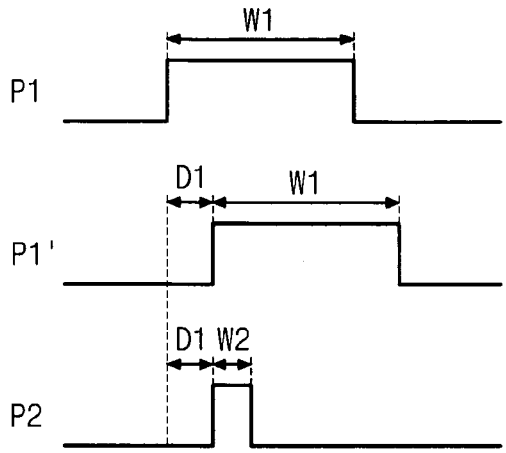
FIG. 5C depicts the waveforms of the input pulse and the output pulse of FIG. 5A or 5B.
Figure 5D:
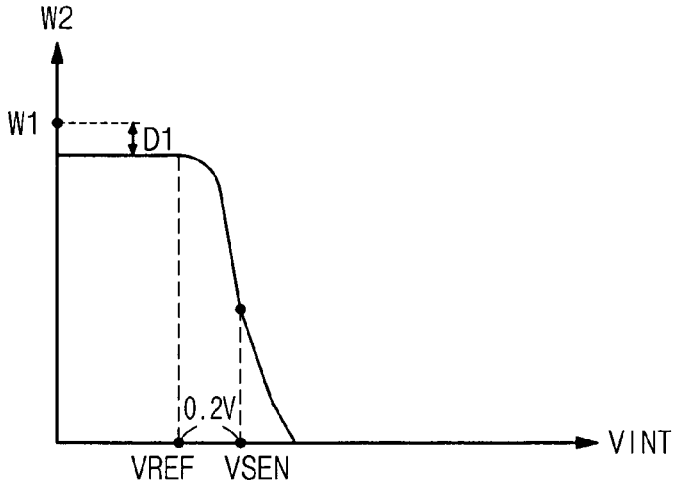
FIG. 5D is a graph illustrating the width of the output pulse as a function of the internal voltage of FIG. 5A or 5B.
Figure 5E:
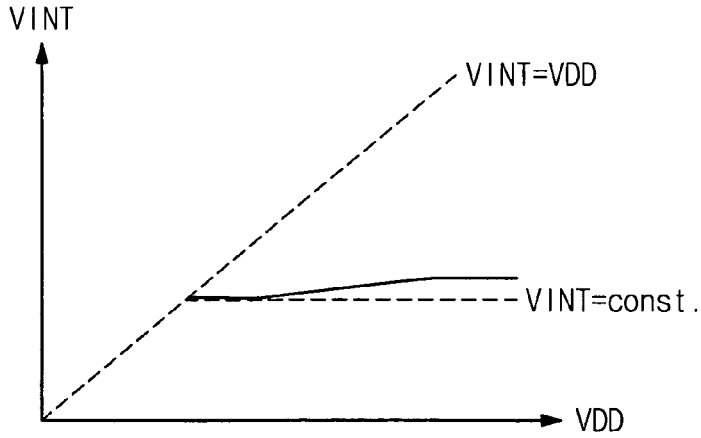
FIG. 5E is a graph illustrating the internal voltage as a function of the external voltage of FIG. 3.

FIG. 5A is a circuit diagram of the variable pulse generating circuit of FIG. 3 according to a third embodiment of the present invention, and FIG. 5B is a circuit diagram of the variable pulse generating circuit of FIG. 3 according to a fourth embodiment of the present invention. FIG. 5C depicts waveforms of the input pulse P1 and the output pulse P2. FIG. 5D is a graph illustrating the width of the output pulse P2 as a function of the internal voltage, and FIG. 5E is a graph illustrating levels of the internal voltage as a function of the external voltage.

As shown in FIGS. 5A and 5B, the variable pulse generating circuits 200 each include a differential amplifier that is configured to receive a reference voltage VREF and an internal voltage VINT, a precharge unit, an internal voltage sensing level unit, and a delay circuit 210. The differential amplifier includes PMOS transistors mp1 and mp2 and NMOS transistors mn1 and mn2. The precharge unit includes PMOS transistors mp3 and mp4. The internal voltage sensing level unit in the embodiment of FIG. 5A includes resistor R, and comprises resistors R1, R2, R3 and R4 in the embodiment of FIG. 5B.

First, operation of the variable pulse generating circuit 200 will be described as if the internal voltage sensing level unit was not present. When the input pulse P1 is in a low (L) state, the PMOS transistors mp3 and mp4 are turned on. As such, the external voltage VDD precharges the output terminal Vout of the differential amplifier.

When the output terminal Vout of the differential amplifier is precharged to a high (H) state, the input pulse P1 is activated to a high (H) state. The activated input pulse P1 becomes a pulse signal P1', which is delayed by the delay D1 while passing through the delay circuit 210. Accordingly, the output pulse P2 is set to a high level at a time period that is delayed from the pull-up time period of the input pulse P1 by the delay time D1.

While the input pulse P1 is in a high (H) state, the PMOS transistors mp3 and mp4 are turned off and the NMOS transistor mn3 is turned on. If, when the input pulse P1 is in a high (H) state, the internal voltage VINT is higher than the reference voltage VREF, the output terminal Vout of the differential amplifier is set to a low (L) state, and the output pulse P2 is set to a low level because the two terminals of the NAND gate are in high (H) and low (L) states, respectively. As a result, the output pulse P2 is generated as shown in FIG. 5C.

Now, operation of the variable pulse generating circuits 200 of FIGS. 5A and 5B that include the internal voltage sensing level units will be described. In the embodiments of FIGS. 5A and 5B, the internal voltage sensing level units are implemented using resistors. The internal voltage sensing level may be formed at a voltage that is higher than the reference voltage VREF by a predetermined level (for example, 0.2 V). The predetermined level may be changed by changing the resistance. The output pulse P2 is pulled down at a time period when the internal voltage VINT becomes higher than the internal voltage sensing level.

In the embodiment of FIG. 5A, the internal voltage sensing level unit is disposed between the NMOS transistors mn2 and mn3 of the differential amplifier and is controlled by the resistor R. The internal voltage sensing level unit of the embodiment of FIG. 5B is disposed at both the internal voltage input terminal and the reference voltage input terminal of the differential amplifier, and is controlled by a voltage divider circuit. A switching transistor is disposed below the voltage divider circuit in order to reduce consumption of standby current.

FIG. 5D is a graph illustrating the width W2 of the output pulse as a function of the internal voltage. As shown in FIG. 5D, if the internal voltage VINT is lower than the reference voltage VREF or the internal voltage sensing level VSEN while the input pulse P1 is in a high (H) state, the width W2 of the output pulse P2 is narrower than the width W1 of the input pulse P1 by the delay time D1. Accordingly, a maximum width of the output pulse P2 is "W1-D1." Meanwhile, the output pulse P2 is set to a low level when the internal voltage VINT becomes higher than the reference voltage VREF or the internal voltage sensing level VSEN. If the internal voltage VINT is higher than the reference voltage VREF or the internal voltage sensing level VSEN, the width of the output pulse P2 may become zero.

The variable pulse generating circuits 200 of FIGS. 5A and 5B are devices that generate the pulse signal P1' delayed by the response time of the differential amplifier and then generate the output pulse P2 by combining the delayed pulse signal P1' and the output signal Vout of the differential amplifier. These variable pulse generating circuits 200 have an advantage in that the minimum width of the output pulse P2 can be made to be zero. Accordingly, the internal voltage can maintain a constant level even if the external voltage increases. The pull-up time period of the output pulse P2 is delayed by the delay time D1 of the delay circuit 210.

FIG. 5E is a graph illustrating variation of the internal voltage VINT as a function of the external voltage in the internal voltage generator having the variable pulse generating circuit of FIG. 5A or 5B. As can be seen from FIG. 5E, even if the external voltage is increased, the internal voltage VINT may be maintained at a relatively constant level without being increased beyond the predetermined level.

Figure 6A:
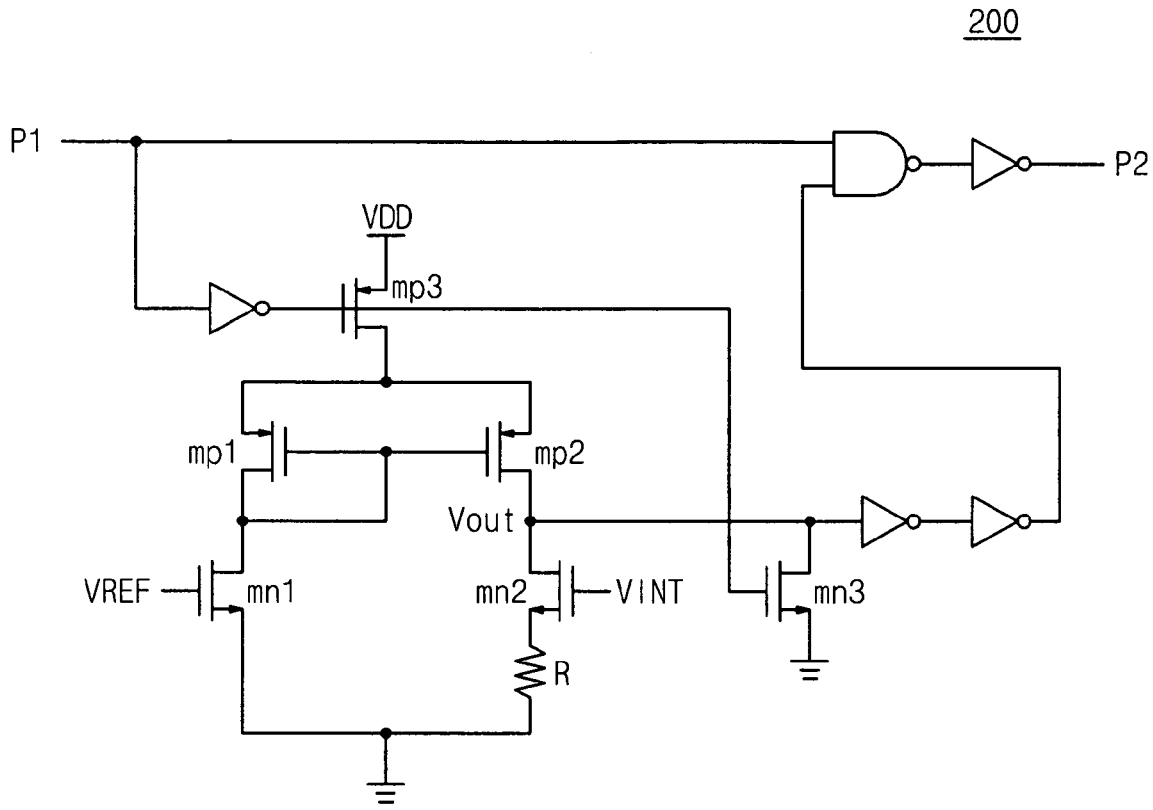
FIG. 6A is a circuit diagram of the variable pulse generating circuit of FIG. 3 according to a fifth embodiment of the present invention.
Figure 6B:
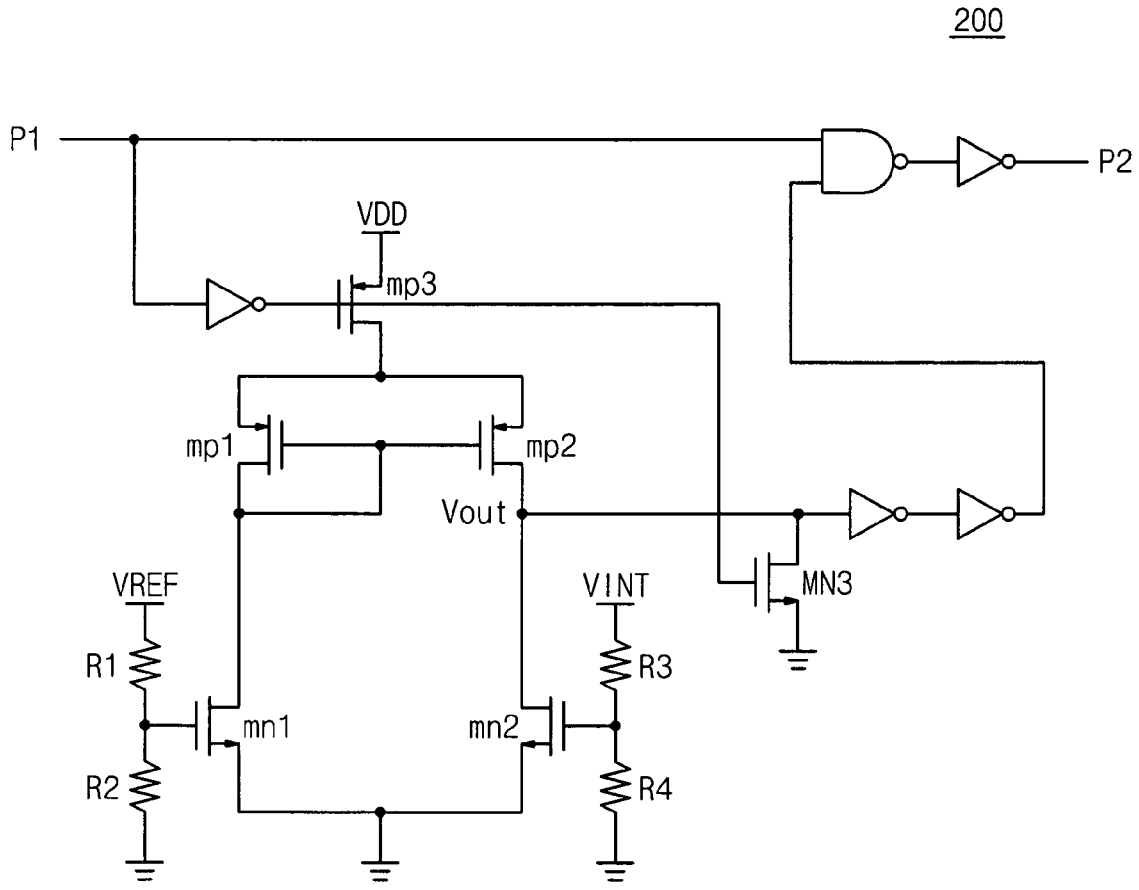
FIG. 6B is a circuit diagram of the variable pulse generating circuit of FIG. 3 according to a sixth embodiment of the present invention.
Figure 6C:
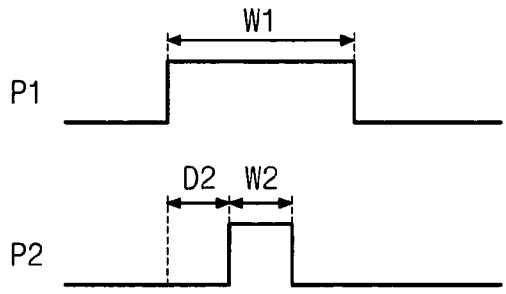
FIG. 6C depicts the waveforms of the input pulse and the output pulse of FIG. 6A or 6B.
Figure 6D:
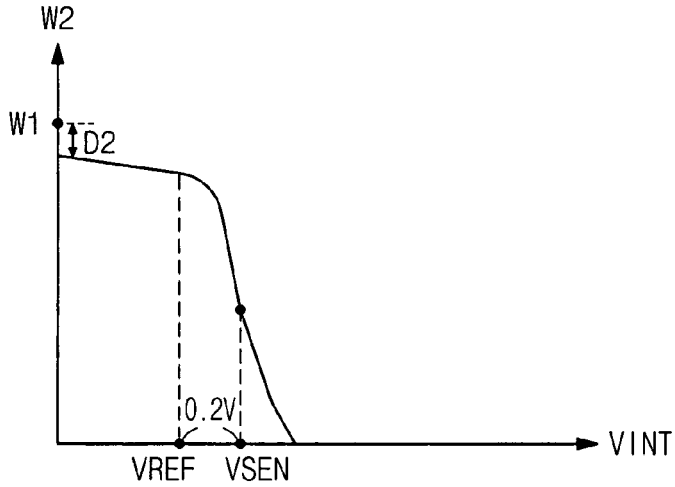
FIG. 6D is a graph illustrating the width of the output pulse as a function of the internal voltage of FIG. 6A or 6B.
Figure 6E:
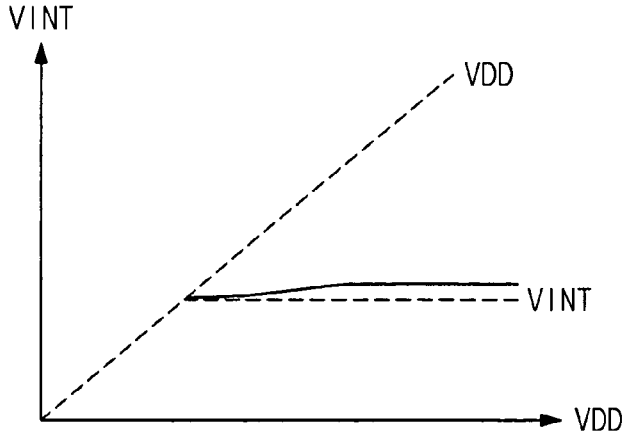
FIG. 6E is a graph illustrating the internal voltage as a function of the external voltage of FIG. 3.

FIG. 6A is a circuit diagram of the variable pulse generating circuit of FIG. 3 according to a fifth embodiment of the present invention, and FIG. 6B is a circuit diagram of the variable pulse generating circuit of FIG. 3 according to a sixth embodiment of the present invention. FIG. 6C depicts waveforms of the input pulse P1 and the output pulse P2. FIG. 6D is a graph illustrating the width of the output pulse P2 as a function of the internal voltage VINT, and FIG. 6E is a graph depicting the internal voltage VINT as a function of the external voltage.

As shown in FIGS. 6A and 6B, the variable pulse generating circuits 200 include a differential amplifier that is configured to receive a reference voltage VREF and an internal voltage VINT, a discharge unit, and an internal voltage sensing level unit. The differential amplifier includes PMOS transistors mp1 and mp2 and NMOS transistors mn1 and mn2. The discharge unit includes NMOS transistor mn3. The internal voltage sensing level unit includes resistor R in the embodiment of FIG. 6A, and resistors R1, R2, R3 and R4 in the embodiment of FIG. 6B.

First, operation of the variable pulse generating circuit 200 will be described as if the internal voltage sensing level unit was not present. When the input pulse P1 is in a low (L) state, the PMOS transistor mp3 is turned off and the NMOS transistor mn3 is turned on. Accordingly, an output terminal Vout of the differential amplifier is discharged to a ground voltage VSS. When the output terminal Vout of the differential amplifier is discharged to a low (L) state, if the input pulse P1 is set to a high level, the two terminals of NAND gate become high (H) and low (L) states, respectively. As a result, the output pulse P2 is set to a low (L) state.

When the input pulse P1 is in a high (H) state, the PMOS transistor mp3 is turned on and the NMOS transistor mn3 is turned off. At this time, if the internal voltage VINT is lower than the reference voltage VREF, the output terminal Vout of the differential amplifier is changed into a high (H) state. In other words, the output pulse P2 is set to a high level when the internal voltage VINT becomes lower than the reference voltage VREF. Accordingly, the output pulse P2 is set to a high level at a time period that is delayed by a time delay D2.

If the internal voltage VINT becomes higher than the reference voltage VREF after the output pulse P2 is set to a high level, the output terminal Vout of the differential amplifier is changed into a low (L) state. If the output terminal Vout of the differential amplifier is changed into a low (L) state when the input pulse P1 is in a high (H) state, the output pulse P2 is pulled down because the two inputs of the NAND gate are in high (H) and low (L) states, respectively. Accordingly, the output pulse P2 is generated as shown in FIG. 6C.

Now, an operation of the variable pulse generating circuits 200 of FIGS. 6A and 6B that include the internal voltage sensing level units will be described. In the embodiments of FIGS. 6A and 6B, the internal voltage sensing level units are implemented using resistors. The internal voltage sensing level may be formed at a voltage that is higher than the reference voltage VREF by a predetermined level (for example, 0.2 V). The predetermined level may be changed by changing the resistance level. The output pulse P2 is set to a low level when the internal voltage VINT becomes higher than the internal voltage sensing level.

In the embodiment of FIG. 6A, the internal voltage sensing level unit is disposed between the NMOS transistors mn2 and mn3 of the differential amplifier and is controlled by the resistor R. The internal voltage sensing level unit of the embodiment of FIG. 6B is disposed at both the internal voltage input terminal and the reference voltage input terminal of the differential amplifier, and is controlled by a voltage divider circuit. A switching transistor is disposed below the voltage divider circuit in order to reduce consumption of standby current.

FIG. 6D is a graph illustrating the width W2 of the output pulse as a function of the internal voltage VINT. As shown in FIG. 6D, if the internal voltage VINT is lower than the reference voltage VREF or the internal voltage sensing level VSEN while the input pulse P1 is in a high (H) state, the width W2 of the output pulse P2 is narrower than the width W1 of the input pulse P1 by the delay time D2. Accordingly, a maximum width of the output pulse P2 "W1-D2." Meanwhile, the output pulse P2 is set to a low level when the internal voltage VINT becomes higher than the reference voltage VREF or the internal voltage sensing level VSEN. If the internal voltage VINT is higher than the reference voltage VREF or the internal voltage sensing level VSEN, the width of the output pulse P2 becomes zero.

The variable pulse generating circuits 200 of FIGS. 6A and 6B have an advantage in that the minimum width of the output pulse P2 can be made to be zero. Accordingly, the internal voltage VINT can maintain a constant level even if the external voltage increases. The pull-up time period of the output pulse P2 is delayed by the delay time D2. Accordingly, if the pull-up time period of the input pulse P1 is delayed, the internal voltage VINT may be dropped, thus lowering an operating speed of the chip.

FIG. 6E is a graph illustrating the internal voltage as a function of the external voltage in the internal voltage generator having the variable pulse generating circuits of FIG. 6A or 6B. As can be seen from FIG. 6E, even if the external voltage is increased, the internal voltage is maintained at a constant level without being increased beyond the predetermined level.

Figure 7:
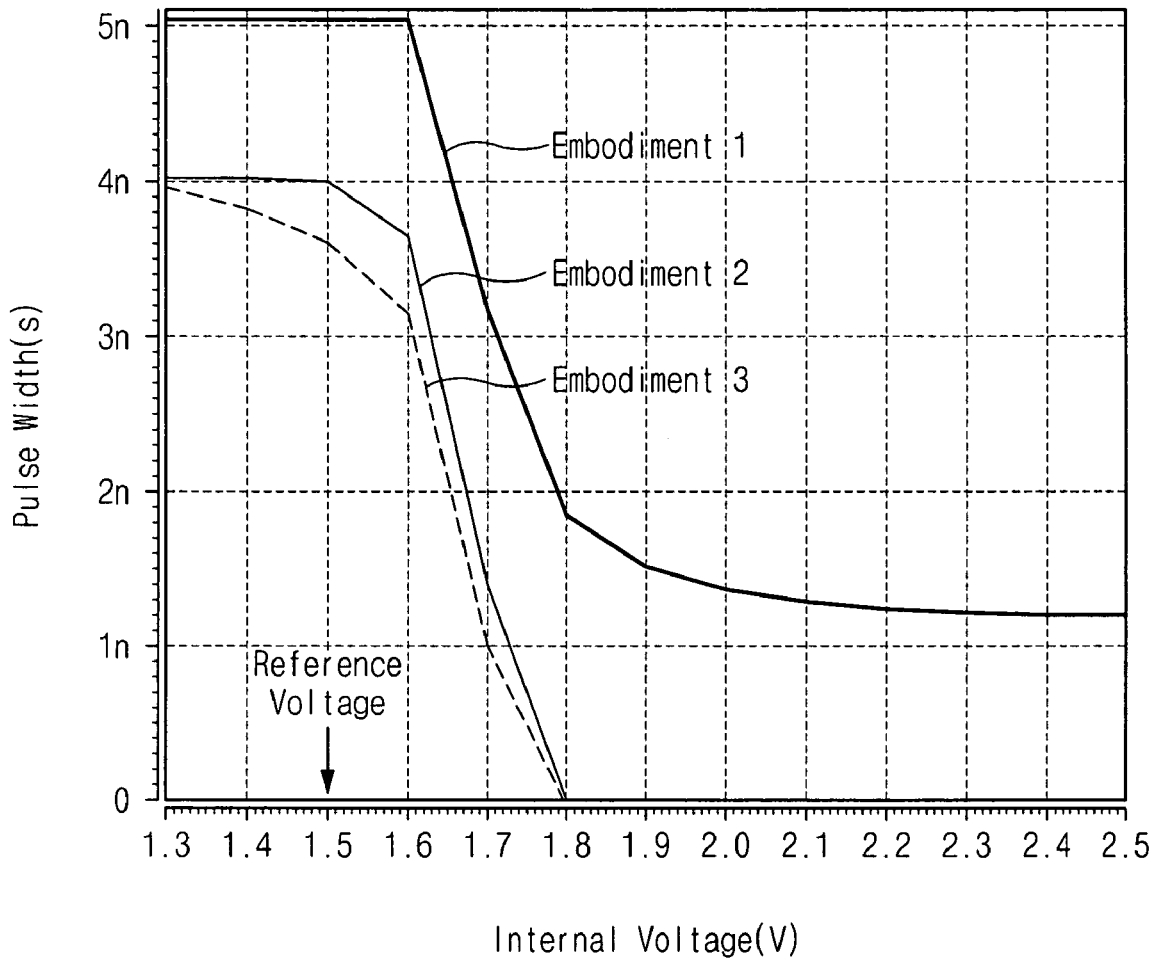
FIG. 7 is a simulation result illustrating the width of the output pulse as a function of the internal voltage.

FIG. 7 is a simulation result illustrating the width of the output pulse as a function of the internal voltage. In FIG. 7, the first to third embodiments refer to the embodiments of FIGS. 4D, 5D and 6D, respectively.

As described above, the width of the variable pulse is controlled by comparing the fed-back internal voltage with the reference voltage or the internal voltage sensing level, so that an internal voltage having a relatively constant level is generated without regard to an increase in the external voltage or the frequency of the operating signal.

In the drawings and specification, there have been disclosed typical embodiments of the invention and, although specific terms are employed, they are used in a generic and descriptive sense only and not for purposes of limitation, the scope of the invention being set forth in the following claims.

What is claimed is:

1. A circuit for selectively supplying an external voltage to an internal circuit, comprising:

a pulse generation circuit that is configured to generate a pulse having a variable pulse length that varies as a function of an input pulse and an internal voltage; and a first driver circuit configured to provide the internal voltage by coupling the external voltage to the internal circuit for a variable time according to the variable pulse length in response to the pulse, wherein the pulse generation circuit generates the pulse in response to the input pulse and terminates the pulse in response to the internal voltage falling below a first reference voltage, wherein the pulse generation circuit comprises a differential amplifier configured to receive the first reference voltage and the internal voltage and a sensing unit that is configured to sense the level of the internal voltage, and wherein the sensing unit comprises at least one resistor disposed between first and second transistors of the differential amplifier.

2. The circuit of claim 1, wherein the first driver circuit comprises a transistor that selectively couples the external voltage to the internal circuit.

3. The circuit of claim 1, further comprising a second driver circuit that couples the pulse to the first driver circuit.

4. The circuit of claim 3, wherein the second driver circuit comprises a transistor that selectively couples a second reference voltage to the first driver circuit in response to the pulse.

5. The circuit of claim 1, further comprising a comparator that generates an output signal based on a comparison of a first reference voltage and the internal voltage, and wherein the first driver circuit further selectively couples the external voltage to the internal circuit responsive to the output of the comparator.

6. The circuit of claim 1, wherein the input pulse is activated in response to an operation of the internal circuit.

7. The circuit of claim 1, wherein the pulse generation circuit further comprises a precharge unit.

8. The circuit of claim 1, wherein the sensing unit comprises a plurality of resistors controlled by a voltage divider circuit.

9. The circuit of claim 1, wherein the pulse generation circuit further comprises a delay circuit that is configured to activate the pulse at a predetermined time after activation of the input pulse.

10. A voltage generation circuit for supplying an operating voltage to an integrated circuit, comprising:

a pulse generating circuit configured to generate a pulse having a variable pulse length that varies as a function of an input pulse and a level of the operating voltage;

a comparator that generates an output based on a comparison of the operating voltage and a reference voltage; and a first driver circuit that selectively provides the operating voltage by coupling an external voltage to the integrated circuit in response to the pulse provided by the pulse generating circuit and the output of the comparator, wherein the pulse generating circuit generates the pulse having the variable pulse length for a variable time according to the input pulse and the level of the operating voltage, wherein the pulse generating circuit comprises a differential amplifier configured to receive the reference voltage and the operating voltage, a sensing unit that is configured to sense the level of the operating voltage and a precharge unit, and wherein the sensing unit comprises at least one resistor disposed between first and second transistors of the differential amplifier.

11. The voltage generation circuit of claim 10, wherein the pulse generated by the pulse generating circuit comprises a rectangular pulse.

12. The voltage generation circuit of claim 10, wherein the pulse generating circuit activates the pulse in response to an input signal and deactivates the pulse in response to the operating voltage falling below a reference voltage.

13. The voltage generation circuit of claim 10, wherein the first driver circuit couples the external voltage to the integrated circuit in response to the output of the comparator indicating that a reference voltage exceeds the operating voltage.

14. The voltage generation circuit of claim 10, wherein the first driver circuit couples the external voltage to the integrated circuit in response to the pulse generating circuit generating the pulse.

15. The voltage generation circuit of claim 10, wherein the first driver circuit comprises a transistor having a control terminal, and wherein the voltage generation circuit further comprises a second driver circuit that couples the output of the pulse generating circuit to the control terminal on the transistor.

16. The voltage generation circuit of claim 10, wherein the pulse is activated in response to an operation of the internal circuit.

17. The voltage generation circuit of claim 10, wherein the sensing unit comprises a plurality of resistors controlled by a voltage divider circuit.

18. The voltage generation circuit of claim 12, wherein the pulse generating circuit further comprises a delay circuit that is configured to activate the pulse at a predetermined time after activation of the input signal.

19. The voltage generation circuit of claim 12, wherein the comparator compares the operating voltage to a reference voltage, and wherein the pulse generating circuit activates the pulse in response to an input signal and deactivates the pulse in response to the operating voltage falling below a voltage sensing level voltage that is a predetermined amount more than the reference voltage.

* * * * *